United States Patent [19]

Lawson

[11] 4,308,777

[45] Jan. 5, 1982

[54] PANEL SCORING TABLE SAW

[75] Inventor: Peter Lawson, S. Paulo, Brazil

[73] Assignee: Rockwell do Brasil Ind. e Com. Ltda., Sao Paulo, Brazil

[21] Appl. No.: 152,080

[22] Filed: May 21, 1980

[30] Foreign Application Priority Data

May 21, 1979 [BR] Brazil ..... 7903150

[51] Int. Cl.[3] ..... B27B 5/24

[52] U.S. Cl. ..... 83/477.2; 83/863; 83/473; 83/508.2; 144/3 R

[58] Field of Search ..... 83/477.2, 473, 861, 83/862, 863, 499, 508.2; 144/3 R; 30/164.95

[56] References Cited

U.S. PATENT DOCUMENTS

| | | | |
|---|---|---|---|
| 3,603,190 | 9/1971 | Kollen | 83/499 |
| 3,670,788 | 6/1972 | Pollak et al. | 83/508.2 |
| 4,058,150 | 11/1977 | Pennington | 83/862 X |
| 4,176,572 | 12/1979 | Pennington | 83/862 |
| 4,181,164 | 1/1980 | Meniconi | 144/3 R |
| 4,245,390 | 1/1981 | Bond | 83/863 X |
| 4,249,442 | 2/1981 | Fittery | 83/477.2 |

*Primary Examiner*—Donald R. Schran

[57] ABSTRACT

A scoring blade operating in advance of the main blade of a tilting arbor saw is mounted to tilt with the main saw blade. Provision is made for adjusting the scoring blade laterally and vertically.

1 Claim, 3 Drawing Figures

PANEL SCORING TABLE SAW

BACKGROUND OF THE INVENTION

With the increased popularity of plywoods with thin veneered finished surfaces and laminated materials with thin finished surfaces, provision has to be made for separating these pieces without unduly damaging the finished surface. One solution in prominent use is a small high speed blade mounted ahead of the normal cutting blade on a table saw. This blade is made to rotate in the reverse direction and makes merely a small or scoring cut. Thus, when the workpiece is moved into engagement with the main blade, the scoring blade has already cut just the finished surface and the main blade then rotating in the usual direction separates the remainder of the material. The smaller or scoring blade is usually mounted to be tilted with a tilting arbor saw so that bevel cuts may be made if desired.

SUMMARY OF THE INVENTION

It is the primary purpose of this invention to provide an adjusting means for aligning the scoring blade with the main blade and at the same time adjusting for the height of the scoring blade above the table surface.

It is a further object of this invention to provide controls accessible to the operator from his normal position at the saw for adjusting the alignment and elevation of this scoring blade.

DESCRIPTION OF THE PREFERRED EMBODIMENT

Figure 1:
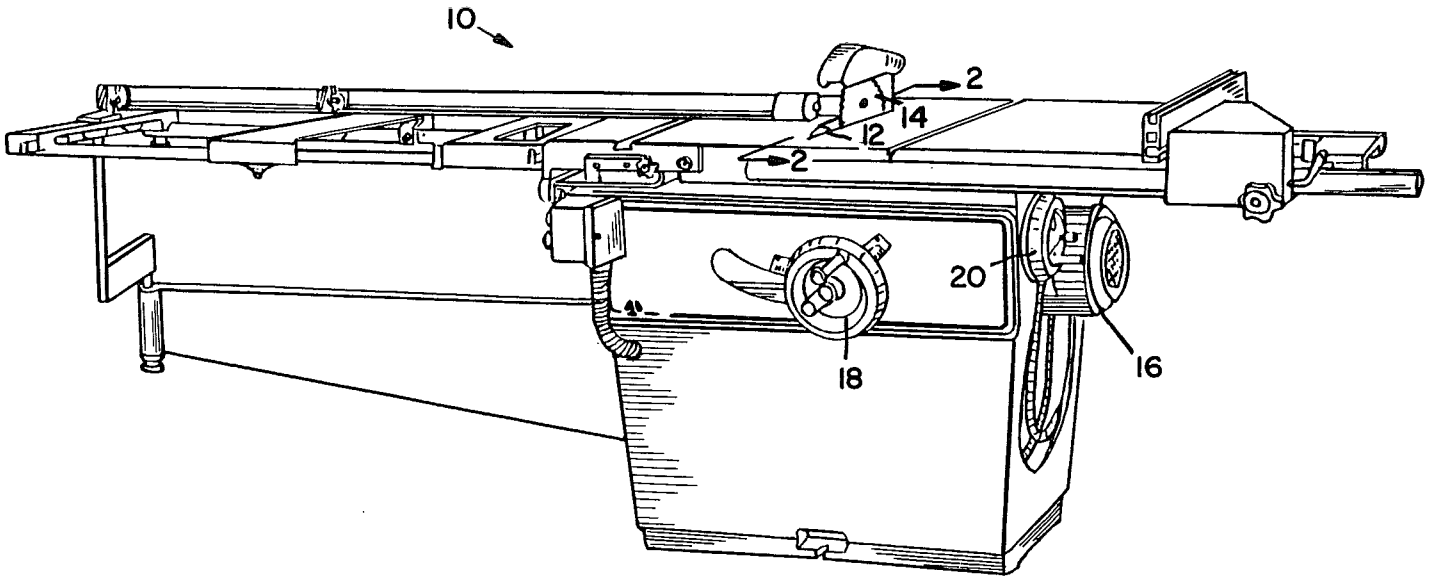
FIG. 1 shows a tilting arbor saw having an attachment for handling extra long panels and showing the scoring blade of the present invention.
Figure 2:
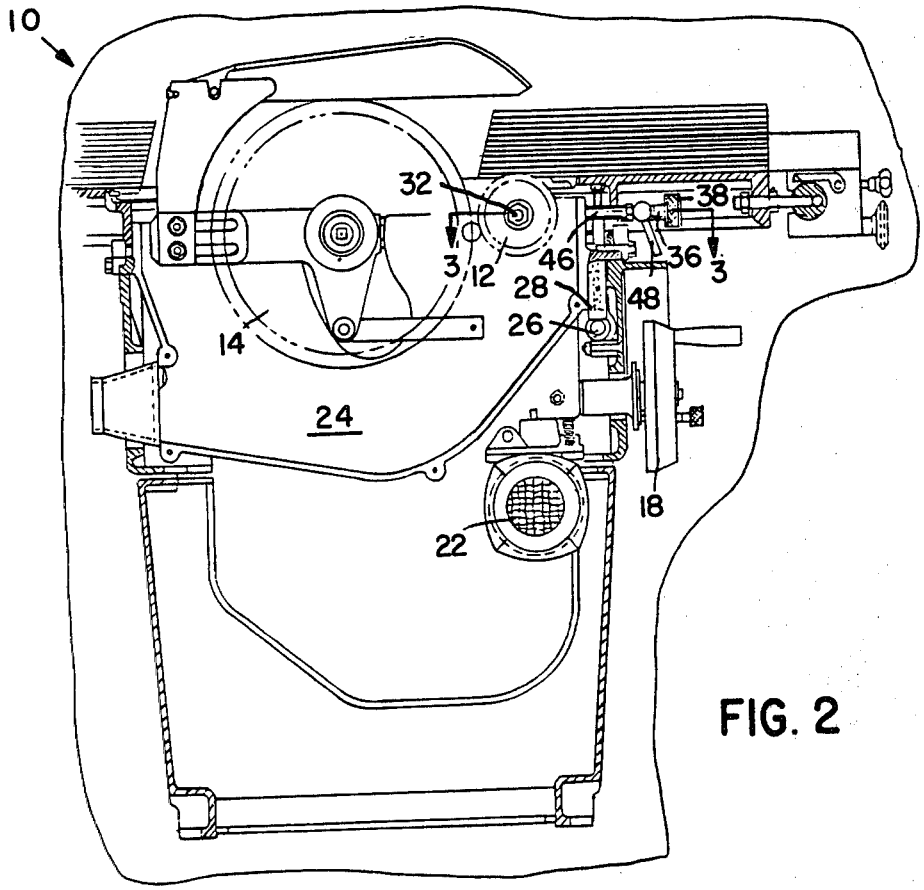
FIG. 2 is a sectional view along the line 2—2 of FIG. 1.

A panel scoring saw 10 is shown in FIGS. 1 and 2 with FIG. 2 showing the location of the scoring blade 12 with respect to the main blade 14. Much of this saw is well-known in the art such as the main drive motor 16 and control handles 18 and 20 for raising the main blade and tilting the blades respectively. In FIG. 2 is seen the auxiliary electric motor 22 for driving scoring blade 12. All the above is well-known in the art.

Figure 3:
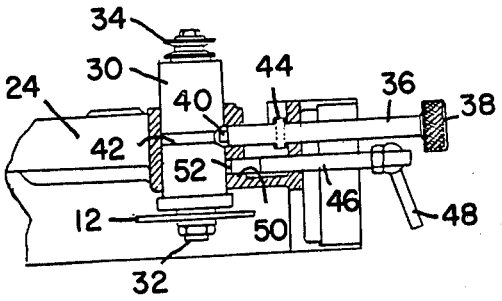
FIG. 3 is a section along the line 3—3 of FIG. 2.

The elevating mechanism (not shown) of the main blade, is mounted on the tilt casting 24 which in turn is mounted on trunions at the front and rear of the saw housing. This casting is rotated in these trunions by operating handle 20 which in turn rotates worm 26 which meshes with gear segment 28, tilting the saw blade to the desired bevel cut. Turning now to FIG. 3 we see a portion of the tilt casting with a housing 30 mounted therein. Housing 30 contains a shaft 32 eccentrically journaled therein. Scoring blade 12 is mounted on one end of the shaft 32 and a pulley 34 is mounted on the other end. Pulley 34 is connected to the pulley of motor 22 by a belt (not shown).

Whenever blade 14 is changed or for some other reason is moved on its shaft, scoring blade 12 must be aligned therewith. This means of alignment comprises a shaft 36 having a knob on the outer end projecting beyond the front wall of the saw and an eccentric reduced diameter portion 40 on the other end which is freely but closely received in groove 42 in the housing 30. A pin 44 is placed in shaft 36 to retain it axially in position in the tilt casting 24. Thus, it can be seen that by rotating knob 38, eccentric 40 moves housing 30 axially inwardly or outwardly as desired. A locking shaft 46 having an operating handle 48 on the outer end accessible to the operator is threadably received in threads 50 of a bore in casting 24. A relatively soft metal tip 52 of lock shaft 46 bears against the periphery of housing 30 retaining it in a selected position.

To effect a change in the alignment of scoring blade 12, the operator need not leave his customary working position and needs no additional tools. He merely reaches under the table for handle 48 and rotates it, thus backing off shaft 46 from contact with housing 30. Then, by rotating knob 38 eccentric 40 will move housing 30 laterally in a desired direction.

Upon completion of the adjustment, the locking handle 48 is rotated to thread shaft 46 inwardly biasing tip 52 against housing 30. An opening in the front wall of the saw accommodates these two shafts in an adjusted position of the saw.

It is seldom that the height of the scoring blade needs adjusting but when it is desired to do so, handle 48 is rotated to release the bias on housing 30 and by rotating housing 30 about its axis, the eccentric mounting of shaft 32 raises or lowers shaft 32, without distrubing the axial alignment.

It can thus be seen that a novel means has been devised for adjusting the scoring blade and retaining the blade in this adjusted position.

While there has been described and shown a preferred form of the invention, obvious equivalent variations are possible in light of the above teachings. It is, therefore, to be understood that, within the scope of the appended claims the invention may be practiced otherwise than as specifically described, and the claims are intended to cover such equivalent variations.

I claim:

1. In a tilting arbor saw having a frame, a tilt casting mounted on the frame by trunions, a main cutting blade and a scoring blade, each axially supported on the tilt casting, the improvement comprising means to adjust the lateral position of the scoring blade so that it is aligned with the main blade, said adjusting means including:

(a) a sleeve-like housing having an inner surface and an outer surface with an annular groove formed therein mounted within the tilt casting to receive the axle of the scoring blade;

(b) alignment means which include: (i) a shaft journaled in the frame, (ii) an eccentric extending from the inner end of said shaft into the annular groove on said sleeve-like housing, and (iii) a hand grip on the outer end thereof to enable rotation of said shaft; and (c) means to lock said sleeve-like housing into the desired lateral position.

* * * * *